US005889923A

United States Patent [19]

Lee et al.

[11] Patent Number: 5,889,923

[45] Date of Patent: Mar. 30, 1999

[54] ELECTRICALLY HEATED STONE BED WITH ELECTROMAGNETIC SHIELDING LAYER

[76] Inventors: Nam Yong Lee, 301 Kongkan Vila, 468-146, Suyu l-Dong, Kangbug-Ku; Hyung Yong Lee, 302-2309 Jayang Hyundai 3rd Apt., 670, Jayang 2-Dong, Kwangjin-Ku, both of Seoul, Rep. of Korea

[21] Appl. No.: 964,553

[22] Filed: Nov. 5, 1997

[30] Foreign Application Priority Data

Apr. 3, 1997 [KR] Rep. of Korea ..... 1997-12304

[51] Int. Cl.[6] ..... A47C 21/04

[52] U.S. Cl. ..... 392/435; 392/339; 219/217; 5/421

[58] Field of Search ..... 392/435, 439, 392/343, 339; 219/217, 212, 213; 5/421; 607/96, 98, 100

[56] References Cited

U.S. PATENT DOCUMENTS

| | | | |
|---|---|---|---|
| 1,589,338 | 6/1926 | White | 607/96 |
| 2,376,902 | 5/1945 | Clark | 219/217 |
| 3,136,090 | 6/1964 | Carnwath | 219/217 |
| 4,663,516 | 5/1987 | Blum | 219/217 |
| 4,680,822 | 7/1987 | Fujino et al. | 5/421 |
| 4,825,868 | 5/1989 | Susa et al. | 219/217 |
| 5,430,900 | 7/1995 | Kim | 5/421 |
| 5,444,878 | 8/1995 | Kang | 5/421 |

FOREIGN PATENT DOCUMENTS

| | | |
|---|---|---|
| 7-255569 | 10/1995 | Japan . |
| 94-2785 | 4/1994 | Rep. of Korea . |

*Primary Examiner*—John A. Jeffery
*Attorney, Agent, or Firm*—Longacre & White

[57] ABSTRACT

A stone bed includes: a stone mat having a wood frame which a sheet is covered around, the wood frame wherein a copper plate, a protective insulating material, a plane carbon heating element, a first protection film, a second protection film, an electromagnetic wave shielding, a third protection film, a far infrared ray nonwoven fabric, and a natural stone are sequentially laid from a bottom, the wood frame having controllers and anion emitters on its both top ends, the controller comprising a power display unit, a selection switch, a temperature control switch, and a temperature display lamp, and a power input cord which is shielding processed; and a bed body having a top surface which the stone mat is mounted on.

3 Claims, 3 Drawing Sheets

ELECTRICALLY HEATED STONE BED WITH ELECTROMAGNETIC SHIELDING LAYER

BACKGROUND OF THE INVENTION

1. Field of the Invention

The present invention relates to a stone bed. Specifically, this invention is a stone bed which emits a great volume of far infrared rays and anion which do a human body good, thereby helping a user to recover from his/her fatigue, accelerating metabolism, and allowing the user to have a clear mind and keep his/her health.

2. Discussion of Related Art

As health becomes great concerns these days, a bed, which is greatly related to sleep which is necessary for relieving one's fatigue, is becoming an important object of the concern. Therefore, various types of beds have been developed.

A most general bed is structured in such a manner that a mat formed by covering around a group of elastic springs with fabric material is mounted on a bed body of a specified shape. Such the bed is very efficient in absorbing a shock due to the springs in the mat. However, as the bed is used for a long time, the buffer effect is deteriorated. There is a problem that a user gets an abnormal symptom, such as a ruptured disk or a curved spine. Additionally, since this bed is not equipped with a special heating device, it cannot satisfy old people who were accustomed to the Korean under-floor heating system.

To prevent the ruptured disk or the curved spine, a bed having supports between the springs in the mat has been developed. However, this bed is not practical because it is not easy to install the supports in the existing mat. Moreover, the supports can be broken.

To solve the heating problem in the bed, a special heating apparatus, such as an electric heating pad, can be used. This heating apparatus is effective in heating the bed, but it generates noxious electromagnetic waves. According to an investigation made in certain areas in America electromagnetic waves can make a person get cancer. This fact makes people avoid using such a heating apparatus.

To solve the above problems, a stone bed has been developed. With reference to FIG. 3, this conventional stone bed is described below in detail.

First, insulating material 112 is put on bed body 110 in stone bed 100. Electric heat line 114 formed with coils is installed on insulating material. Stone plate 116 of a specified size is then mounted. Electric heat line 114 is connected to an electric cord, thus it is used by being plugged in.

This conventional stone bed 100 operates in such a manner that once the electric cord connected electric heat line 114 is plugged in, electric heat line 114 is charged with electricity, thus generating heat, which heats stone plate 116. Bedclothes is used by being spread on stone plate 116 which was heated.

Such the stone bed 100 can prevent a ruptured disk or a curved spine since a part which a human body is in contact with is hard stone plate 116 in this bed. It also has the same heating effect as the Korean under-floor heating system. However, since this bed 100 employs electric heat line 114 using electricity to heat stone plate 116, a great amount of electromagnetic waves which do harm to a human body are directly emitted. Consequently, this bed does not solve the problem of causing cancer. Additionally, a user can be burnt because the bed does not have an over-heat preventer, i.e. an element for controlling a temperature of stone plate 116. There is also a possibility that electric heat line 114 is disconnected after it was used for a long time, causing a troublesome of repairs.

SUMMARY OF THE INVENTION

Accordingly, the present invention is directed to a stone bed that substantially obviates one or more of the limitations and disadvantages of the related art.

An objective of the present invention is to provide a stone bed which emits a great volume of far infrared rays and anion which do a human body good, thereby helping a user to recover from his/her fatigue, accelerating metabolism, and allowing the user to have a clear mind and keep his/her health.

Additional features and advantages of the invention will be set forth in the description which follows, and in part will be apparent from the description, or may be learned by practice of the invention. The objectives and other advantages of the invention will be realized and attained by the structure as illustrated in the written description and claims hereof, as well as the appended drawings.

To achieve these and other advantages, and in accordance with the purpose of the present invention as embodied and broadly described, a stone bed includes: a stone mat having a wood frame which a sheet is covered around, the wood frame wherein a copper plate, a protective insulating material, a plane carbon heating element, a first protection film, a second protection film, an electromagnetic wave shielding, a third protection film, a far infrared ray non-woven fabric, and a natural stone are sequentially laid from a bottom, the wood frame having controllers and anion emitters on its both top ends, the controller comprising a power display unit, a selection switch, a temperature control switch, and a temperature display lamp, and a power input cord which is shielding processed; and a bed body having a top surface which the stone mat is mounted on.

An over heat preventer is installed on the protective insulating material.

The electromagnetic wave shielding is covered around the wood frame under the sheet.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF PREFERRED EMBODIMENT

Reference will now be made in detail to the preferred embodiments of the present invention, examples of which are illustrated in the accompanying drawings.

With reference to the attached drawings, the present invention is described below.

Figure 1:
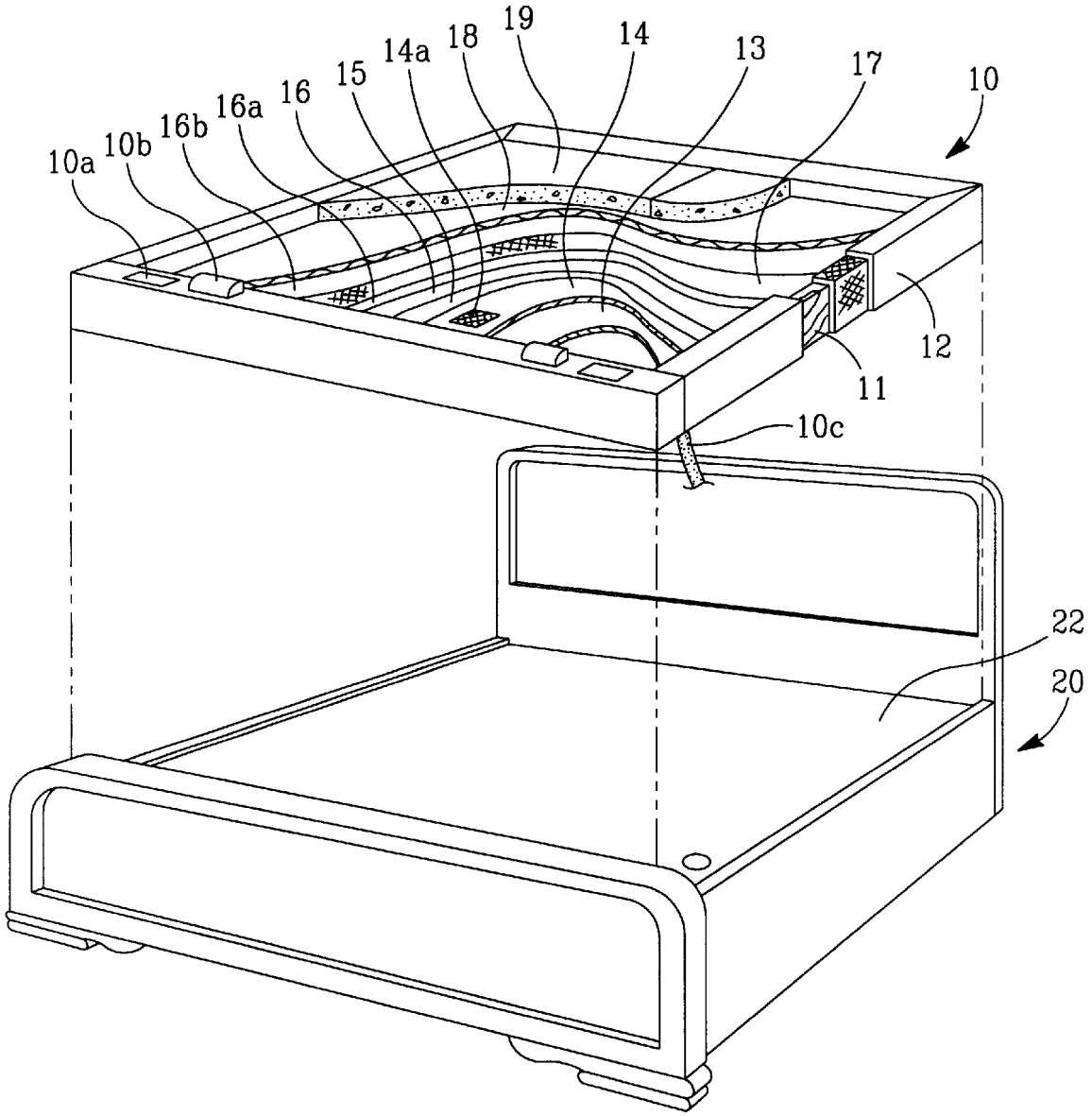
FIG. 1 is a schematic exploded perspective view where an essential part is cut according to the present invention.
Figure 2:
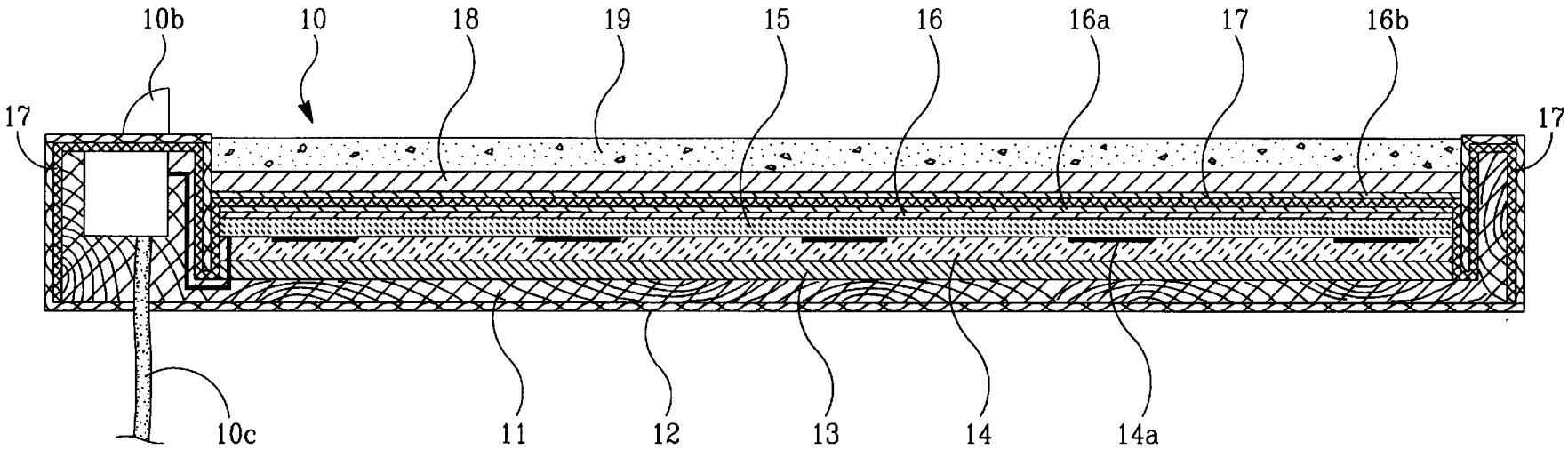
FIG. 2 is a schematic vertical longitudinal sectional view of a stone mat according to the present invention.
Figure 3:
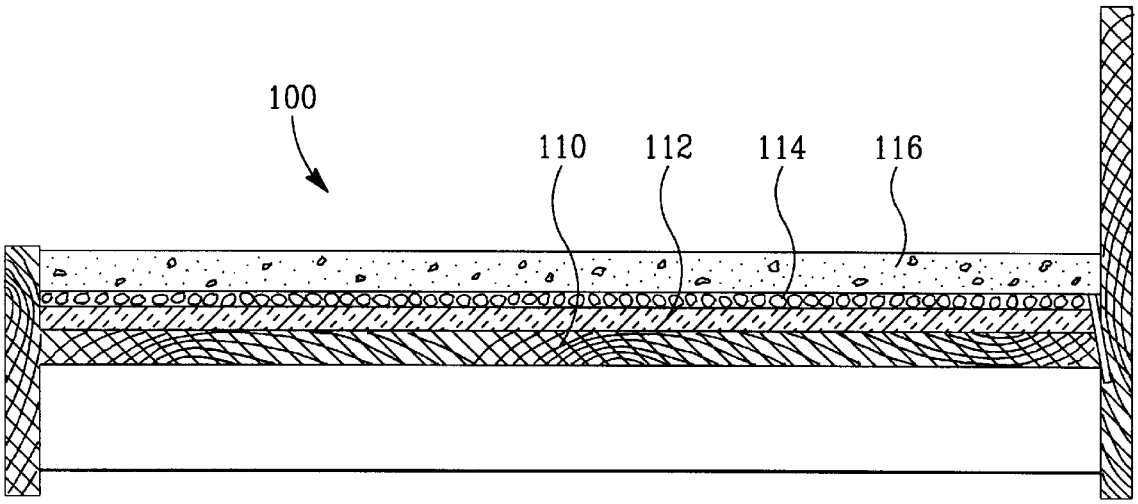
Fig. 3 Prior Art
FIG. 3 is a schematic vertical longitudinal sectional view of a stone bed according to prior art.

FIG. 1 is a schematic exploded perspective view where an essential part is cut according to the present invention. FIG. 2 is a schematic vertical longitudinal sectional view of a stone mat according to the present invention. Sheet 12 of natural leather is covered around wood frame 11. The following elements are sequentially laid from the bottom of wood frame 11: copper plate 13 for intercepting influence of water flow; protective insulating material 14 made of highly pressed styrofoam; plane carbon heating element 15 for receiving electric power and emitting a great volume of far infrared rays, heat, and anion; first protection film 16 and second protection film 16*a* whereupon ceramics and carbon are applied for preventing static electricity; electromagnetic wave shielding 17 which is a grounding net containing chrome for intercepting noxious electromagnetic waves; third protection film 16*b* made of polyethylene resin containing silicone for intercepting magnetism; and far infrared ray nonwoven fabric 18 and natural stone 19 whose maximum radiation rate is 98%. Controllers 10*a* and anion emitters 10*b* are installed on both top ends of wood frame 11, respectively. Controller 10*a* consists of a power display unit, a selection switch, temperature control switch, and a temperature display lamp. All the elements described above constitutes stone mat 10 with power input cord 10*c*. Stone mat 10 is mounted on top surface 22 of bed body 20.

Over heat preventer 14*a* is installed on protective insulating material 14. Electromagnetic wave shielding 17 is covered around wood frame 11 under sheet 12 to intercept noxious electromagnetic waves generated from a wire connected to plane carbon heating element 15 and over heat preventer 14*a*.

The operation and effect of the present invention is described below in detail with reference to FIGS. 1 and 2. Stone mat 10 is mounted on top surface 22 of bed body 20. Once stone mat 10 is charged with electricity through power input cord 10*c*, anion emitter 10*b* installed on the top of wood frame 11 emits anion, and controller 10*a* controls temperature. Electric power is applied to over heat preventer 14*a* and plane carbon heating element 15, thus sequentially heating first protection film 16, second protection film 16*a*, electromagnetic wave shielding 17, third protection film 16*b*, far infrared ray unwoven fabric 18, and natural stone 19.

Current uniformly flows in a conductive layer internally contained by a film in plane carbon heating element 15, thus electric resistance generates heat, and an inorganic oxide emits a far infrared ray. Far infrared rays emitted by plane carbon heating element 15 is combined with ones generated by far infrared ray unwoven fabric 18 and ones generated by natural stone 19 which is mounted on far infrared ray unwoven fabric 18, thus a great volume of far infrared rays are generated, implementing safe heating.

Anion emitter 10*b* made on the top end of wood frame 11 emits much anion which is usually contained in fresh air of forests or secluded valleys. A user can directly assimilate such anion through skin or breathing, which accelerates metabolism, prevents diseases, and makes feel fresh.

A user can control the temperature of natural stone 19 which is in contacted with a human body, using controller 10*a* which consists of a power display unit, a selection switch, temperature control switch, and a temperature display lamp. The user can select a proper temperature for fomentation, sleep, or absence, by operating the selection switch. The user can check the temperature, which is controlled by using the temperature control switch, with his/her eyes through the temperature display lamp, thus facilitating operation.

Natural stone 19 in stone mat 10 can be divided into two or more pieces, so a user can utilize whole natural stone 19 or only some pieces of natural stone 19 according to his/her necessity. Natural stone 19 divided into several pieces is easily carried and set up, thus improving convenience in using the product. The user can heat only one part of natural stone 19 by using one controller between two controllers 10*a* installed on both top ends in stone mat 10.

Noxious electromagnetic waves generated from the wire connected to over heat preventer 14*a* and plane carbon heating element 15 are intercepted by electromagnetic wave shielding 17 which is formed in a grounding net containing chrome and spread covering wood frame 11, thus not doing harm to a human body. Besides noxious electromagnetic waves, magnetism and static electricity generated by using electricity are also intercepted by firsthand second protection films 16 and 16*a* whereupon ceramics and carbon are applied, and third protection film 16*b* which is made of polyethylene resin containing silicone. Additionally, noxious electromagnetic waves generated from power input cord 10*c* are intercepted by shielding power input cord 10*c* which outer electric power is applied to. Therefore, substances which do harm to the human body are completely intercepted in this stone bed.

Stone mat 10 can be removed from top surface 22 of bed body 20 and laid on the floor of a room. It can be also rearranged for a single size.

As described above, the present invention provides hot fomentation effects provides healthful anion and far infrared rays which do good to a human body, and intercepts all noxious electromagnetic waves generated from electric cords, thereby helping the user to recover from his/her fatigue, accelerating metabolism, and allowing the user to have a clear mind and keep his/her health.

It will be apparent to those skilled in the art that various modifications and variations can be made in a stone bed of the present invention without deviating from the spirit or scope of the invention. Thus, it is intended that the present invention cover the modifications and variations of this invention provided they come within the scope of the appended claims and their equivalents.

What is claimed is:

1. A stone bed comprising:

a stone mat including the following layers disposed directly upon one another from a bottom layer to a top layer, said stone mat comprising a wood frame covered by a sheet, a copper plate disposed on the wood frame, an insulating material disposed on the copper plate, a plane carbon heating element disposed on the copper plate, a protection film disposed on the heating element, an electromagnetic wave shielding disposed on the protection film, a nonwoven fabric disposed on the shielding, and a natural stone disposed on the fabric.

2. The stone bed according to claim 1, further comprising:

a bed body having a top surface upon which the stone mat is mounted.

3. The stone bed according to claim 1, further comprising:

a power cord input attached to the heating element of the stone mat, and at least one control unit attached to the stone mat which controls a temperature setting for the stone mat.

* * * * *